US012570437B2

(12) United States Patent
Ott

(10) Patent No.: US 12,570,437 B2
(45) Date of Patent: Mar. 10, 2026

(54) STACKABLE DUST BUCKET HAVING A MULTIFUNCTION CONTOURED RIM

(71) Applicant: Keith Ott, Taylors, SC (US)

(72) Inventor: Keith Ott, Taylors, SC (US)

( * ) Notice: Subject to any disclaimer, the term of this patent is extended or adjusted under 35 U.S.C. 154(b) by 177 days.

(21) Appl. No.: 18/332,211

(22) Filed: Jun. 9, 2023

(65) Prior Publication Data

US 2023/0406570 A1 Dec. 21, 2023

Related U.S. Application Data

(60) Provisional application No. 63/353,628, filed on Jun. 19, 2022.

(51) Int. Cl.

| | |
|---|---|
| ***B65D 21/02*** | (2006.01) |
| ***B65D 25/32*** | (2006.01) |
| ***B65D 25/40*** | (2006.01) |
| ***B65D 43/02*** | (2006.01) |

(52) U.S. Cl.

CPC ..... *B65D 21/0209* (2013.01); *B65D 25/32* (2013.01); *B65D 25/40* (2013.01); *B65D 43/0202* (2013.01)

(58) Field of Classification Search

CPC .... B65D 25/32; B65D 25/40; B65D 43/0202; B65D 21/0209; B65D 21/0233

USPC ..... 206/508

See application file for complete search history.

(56) References Cited

U.S. PATENT DOCUMENTS

| | | | | | |
|---|---|---|---|---|---|
| 527,471 | A * | 10/1894 | Wilson | B65D 25/42 | 222/469 |
| D462,491 | S * | 9/2002 | Hauenstein | D32/53 | |
| D651,780 | S * | 1/2012 | Grasteit | D34/1 | |
| 8,438,921 | B1 * | 5/2013 | Bland | G01F 19/00 | 73/426 |
| D769,563 | S * | 10/2016 | Garcia | D32/74 | |
| 9,532,694 | B1 * | 1/2017 | Shippen | A47L 13/12 | |
| D918,513 | S * | 5/2021 | Morgan | D32/53 | |
| 11,040,827 | B1 * | 6/2021 | Tejeda | B65F 1/10 | |
| 2006/0278553 | A1 * | 12/2006 | Diamond | B65D 25/32 | 206/515 |
| 2009/0294322 | A1 * | 12/2009 | Baltz | B65D 25/32 | 206/519 |
| 2011/0283474 | A1 * | 11/2011 | McCoy | B65F 1/10 | 15/257.1 |
| 2013/0334241 | A1 * | 12/2013 | Abdi | B65D 43/0212 | 220/837 |

(Continued)

FOREIGN PATENT DOCUMENTS

| | | | | |
|---|---|---|---|---|
| DE | 102018112237 | A1 * | 11/2019 | B65D 43/0212 |
| FR | 2684073 | A1 * | 5/1993 | A47J 47/18 |

*Primary Examiner* — Don M Anderson
*Assistant Examiner* — Justin Caudill
(74) *Attorney, Agent, or Firm* — Price Heneveld LLP

(57) ABSTRACT

A stackable container includes a circular base. A body portion extends upward from the circular base. A rim section has an opening, wherein the body portion extends between the circular base and the rim section to define a container volume. The rim section includes an outwardly extending spout that is defined within an upper edge, and a ramp section that defines a linear portion of the upper edge. The linear portion of the ramp section defines a transitional interface where material on a substrate can be transported into the container volume via the ramp section resting on the substrate.

20 Claims, 10 Drawing Sheets

(56) References Cited

U.S. PATENT DOCUMENTS

| | | | | |
|---|---|---|---|---|
| 2014/0076893 | A1* | 3/2014 | Cheek | B65D 1/40<br>220/669 |
| 2016/0037994 | A1* | 2/2016 | Wollman | B65F 1/10<br>15/257.7 |
| 2016/0272388 | A1* | 9/2016 | Slack | B65D 25/32 |
| 2020/0354144 | A1* | 11/2020 | Thompson | B65F 1/10 |

* cited by examiner

STACKABLE DUST BUCKET HAVING A MULTIFUNCTION CONTOURED RIM

CROSS-REFERENCE TO RELATED APPLICATION

This application claims priority to and the benefit under 35 U.S.C. § 119(e) of U.S. Provisional Patent Application No. 63/353,628, filed on Jun. 19, 2022, entitled DUST BUCKET, the entire disclosure of which is hereby incorporated herein by reference.

FIELD OF THE DISCLOSURE

The present disclosure generally relates to a container, such as a bucket, that can be used for various purposes, and more specifically a container having a contoured rim that can be utilized for various functions, and where the contoured rim allows for a nesting and stackable configuration of multiple containers.

BACKGROUND OF THE DISCLOSURE

Multipurpose buckets come in various sizes that include one pint sizes up to five gallon sizes or more. These buckets are convenient because they can be stackable and can be used for a wide range of purposes. Typically, these buckets are used for carrying waste, paint, various materials, and for general storage purposes.

SUMMARY OF THE DISCLOSURE

According to one aspect of the present disclosure, a stackable container includes a circular base. A body portion extends upward from the circular base. A rim section has an opening, wherein the body portion extends between the circular base and the rim section to define a container volume. The rim section includes an outwardly extending spout that is defined within an upper edge, and a ramp section that defines a linear portion of the upper edge. The linear portion of the ramp section defines a transitional interface where material on a substrate can be transported into the container volume via the ramp section resting on the substrate.

According to another aspect of the present disclosure, a stackable container includes a circular base. A body portion extends upward from the circular base. A rim section has an upper edge, wherein the body portion extends between the circular base and the upper edge to define a container volume. The rim section includes a circular portion and a ramp section that extends outward from the circular portion to define a linear portion of the upper edge. The linear portion of the ramp section defines a transitional interface where material on a substrate can be transported into the container volume via the ramp section resting on the substrate.

According to yet another aspect of the present disclosure, a stackable container includes a circular base. A body portion extends upward from the circular base. A rim section has an opening, wherein the body portion extends between the circular base and the rim section to define a container volume. The rim section includes an outwardly extending spout that is defined within an upper edge, and a ramp section defines a linear portion of the upper edge. A lid engages the upper edge of the rim section, and includes a spout portion that selectively engages and covers the outwardly extending spout and the ramp section. The upper edge of the rim section includes a planar upper surface that extends continuously through the outwardly extending spout and the ramp section. The linear portion of the ramp section defines a transitional interface where material on a substrate can be transported into the container volume via the ramp section resting on the substrate.

These and other features, advantages, and objects of the present disclosure will be further understood and appreciated by those skilled in the art by reference to the following specification, claims, and appended drawings.

The components in the figures are not necessarily to scale, emphasis instead being placed upon illustrating the principles described herein.

DETAILED DESCRIPTION

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
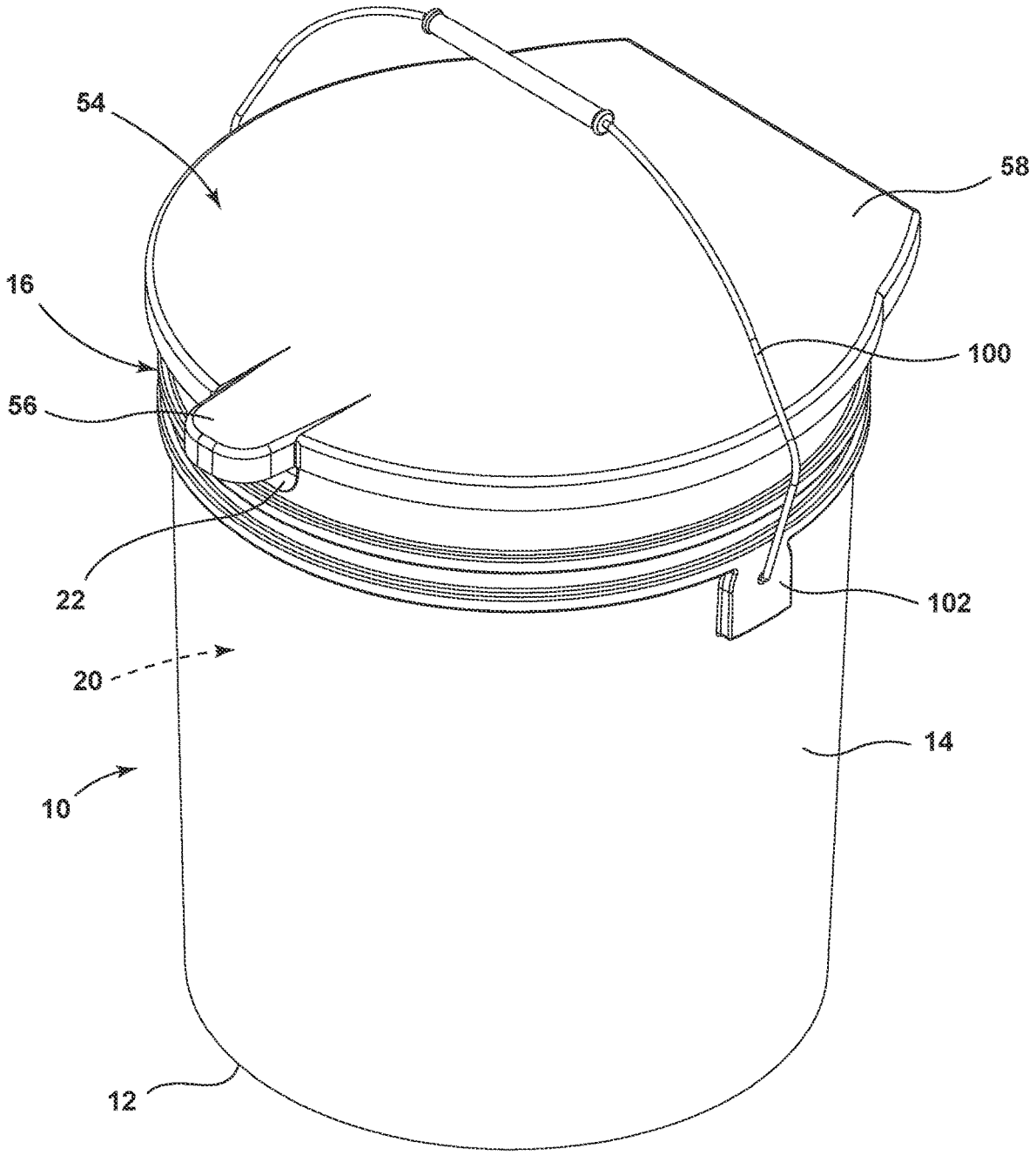
FIG. 1 is a top perspective view of an aspect of the stackable container shown with the lid attached to the upper edge.
Figure 2:
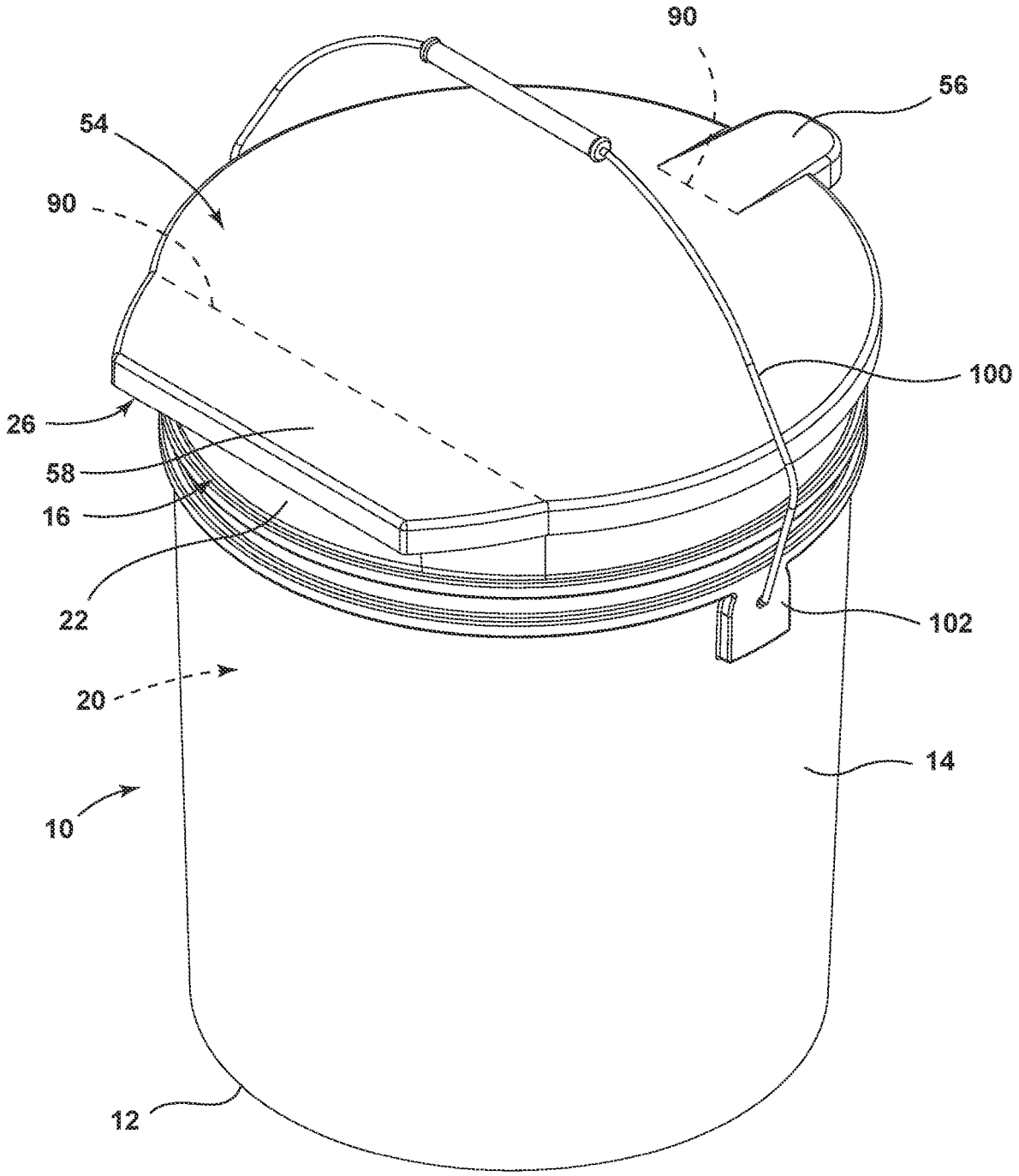
FIG. 2 is a second top perspective view of an aspect of the stackable container of FIG. 1.
Figure 3:
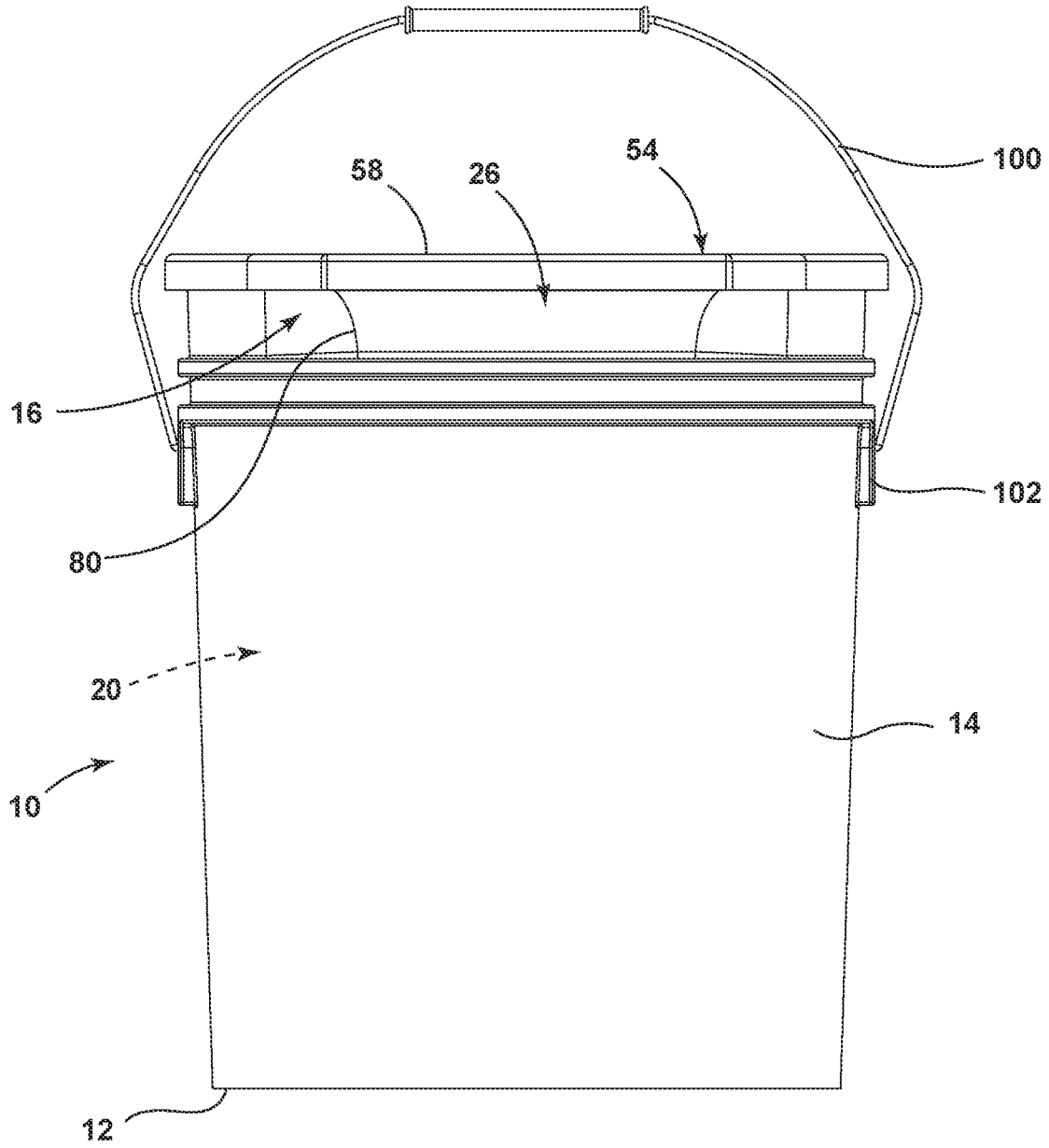
FIG. 3 is a side elevational view of the stackable container of FIG. 1.
Figure 4:
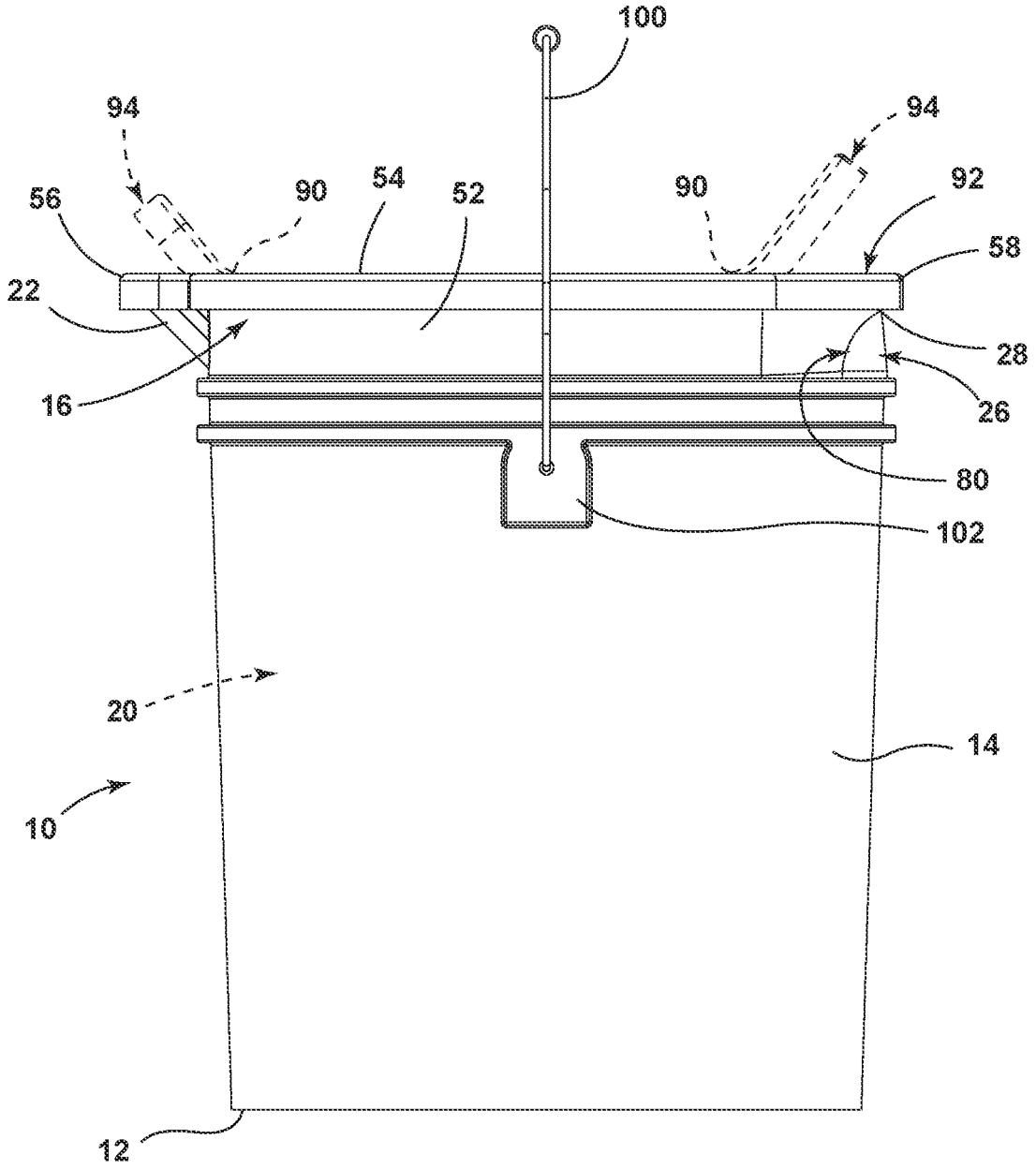
FIG. 4 is another side elevational view of the stackable container of FIG. 1.
Figure 5:
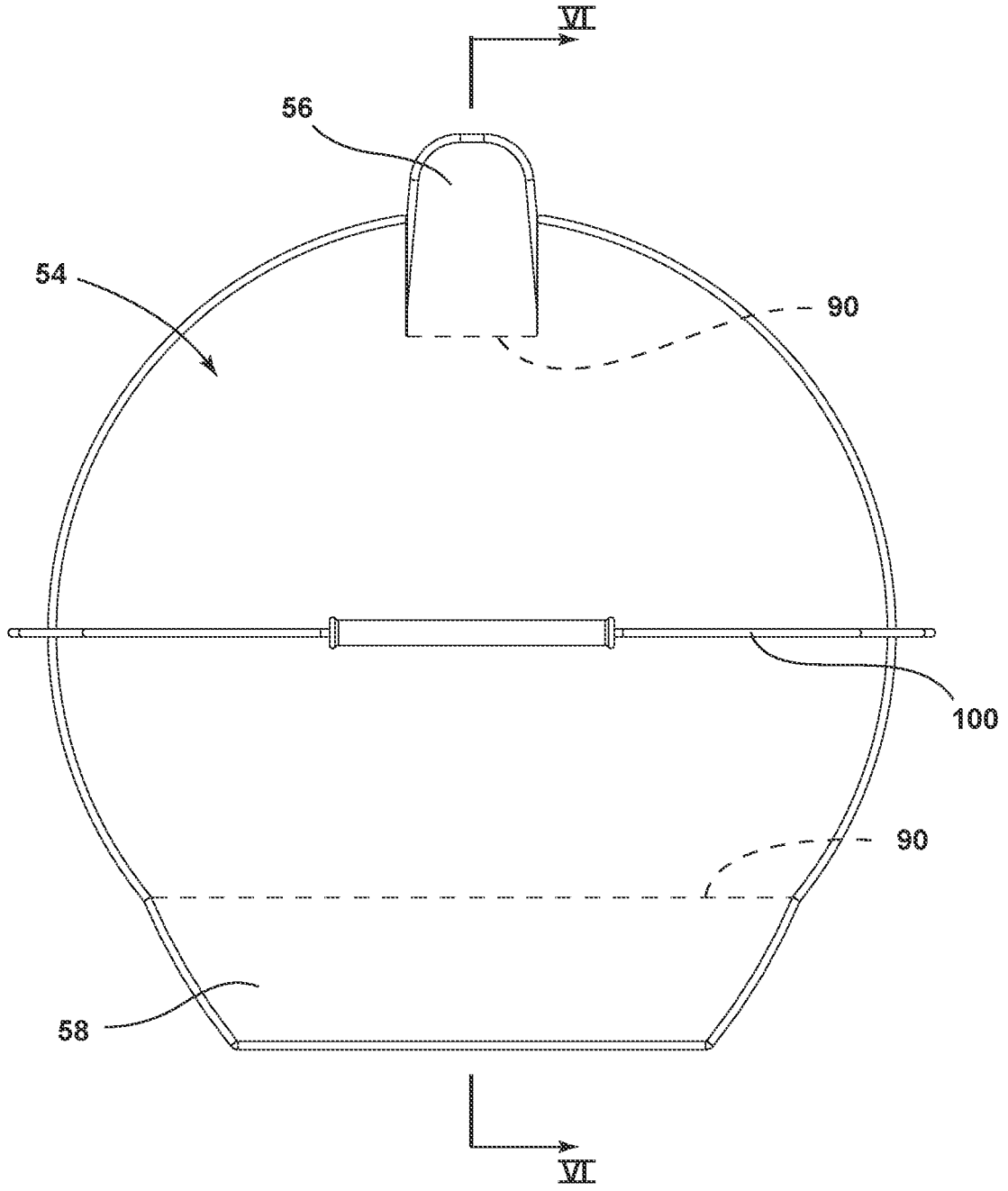
FIG. 5 is a top plan view of the stackable container of FIG. 1.
Figure 6:
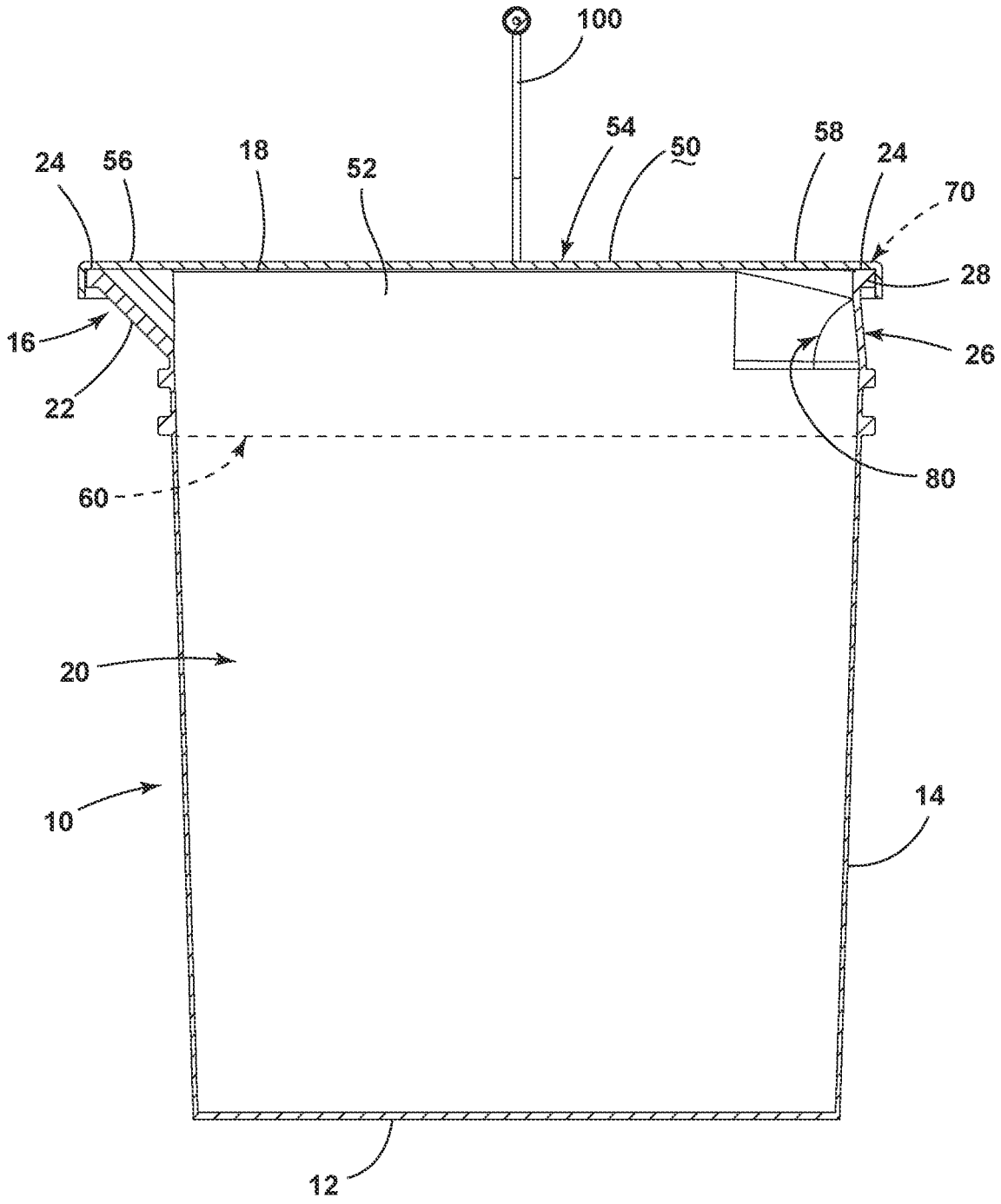
FIG. 6 is a cross-sectional view of the stackable container of FIG. 5, taken along line VI-VI.
Figure 7:
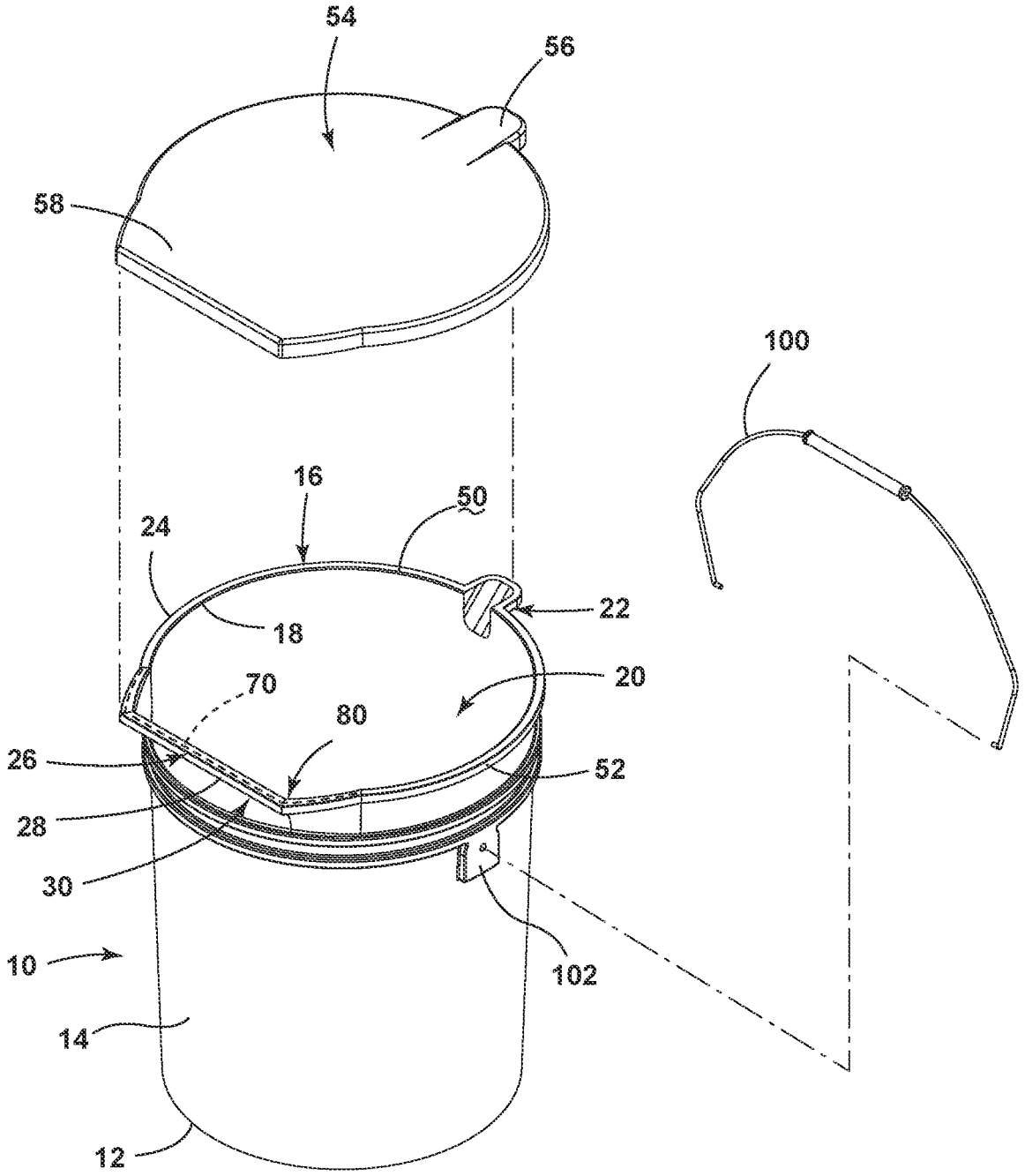
FIG. 7 is an exploded perspective view of the stackable container of FIG. 1.
Figure 8:
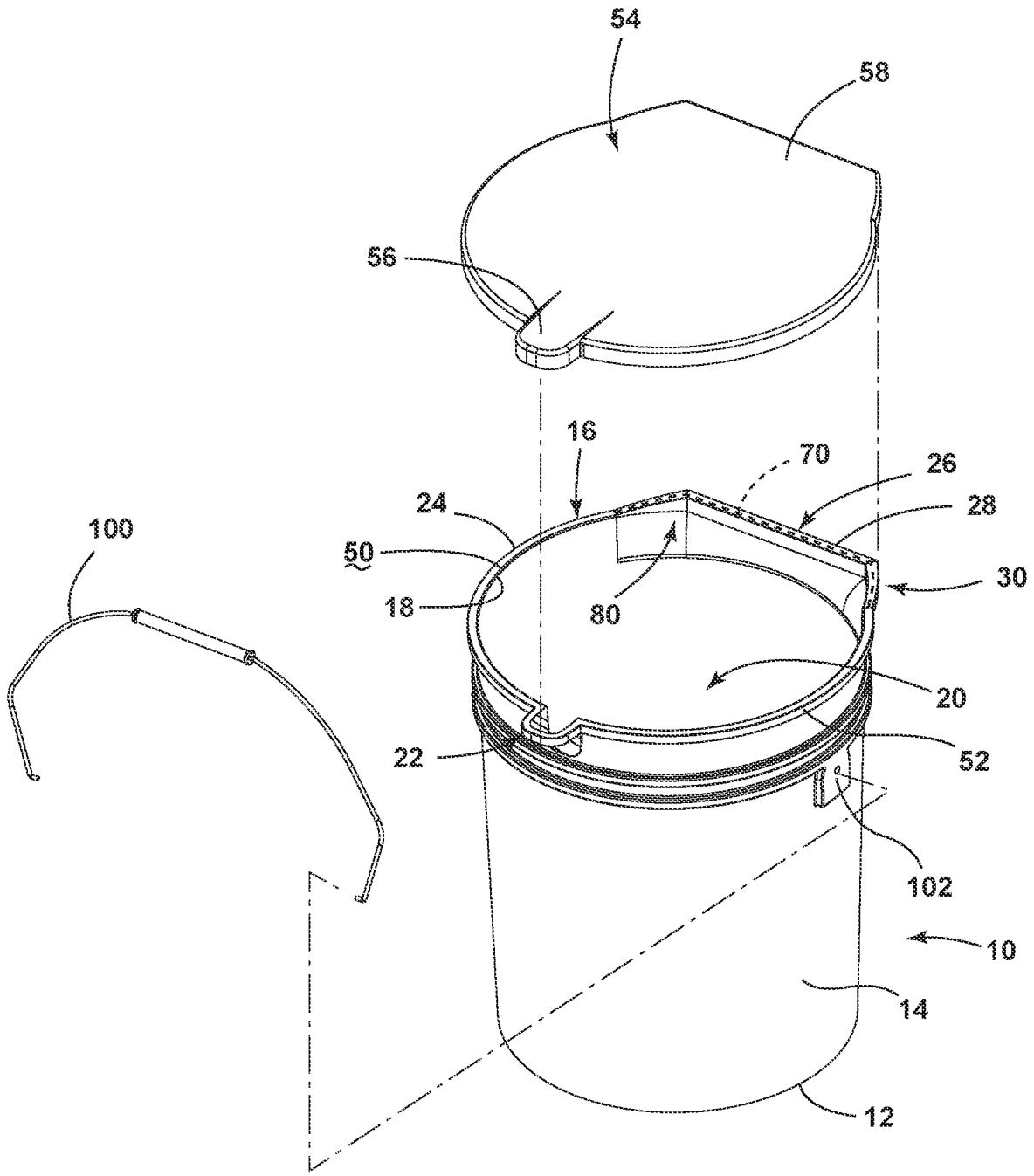
FIG. 8 is another exploded perspective view of the stackable container of FIG. 1.
Figure 9:
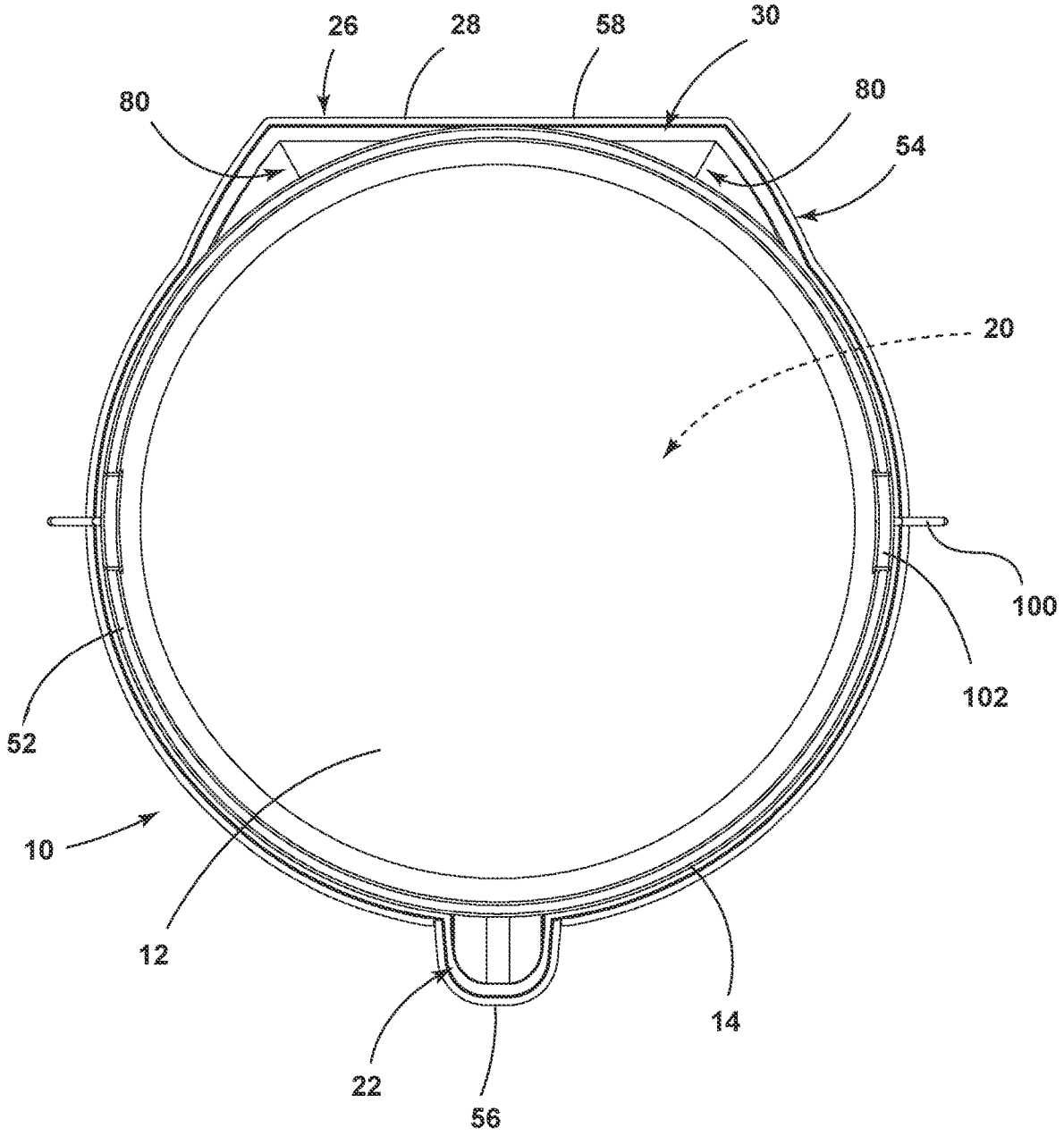
FIG. 9 is a bottom plan view of the stackable container of FIG. 1.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a stackable container having a contoured upper edge, where the upper edge defines a multifunction interface that includes a pour spout and a transitional interface in the form of a ramp section that can be used as a material collection system. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-10, reference numeral 10 generally designates a stackable container. The stackable container 10 can include any one of various sizes. Typically, the stackable container 10 is in the form of a five gallon container commonly seen on construction sites and for residential, commercial and industrial use. It is contemplated that other sizes of the container 10 can be utilized according to the aspects of this disclosure. Such container 10 sizes can include, but are not limited to, one liter, one gallon, ten gallon, and other various sizes and equivalents thereof.

Referring again to FIGS. 1-10, according to various aspects of the device, the stackable container 10 includes a circular base 12 and a body portion 14 that extends upward from the circular base 12. The body portion 14 is typically in the form of a cylindrical body portion 14 or a slightly tapered cylindrical form that allows for nesting of multiple containers 10 for storage purposes. A rim section 16 is attached to the body portion 14 and includes an opening 18. The body portion 14 extends between the circular base 12 and the rim section 16 to define a container volume 20. The rim section 16 includes an outwardly extending spout 22 that is defined within an upper edge 24 of the rim section 16. A ramp section 26 defines a linear portion 28 of the upper edge 24. The linear portion 28 of the ramp section 26 defines a transitional interface 30. Using this transitional interface 30, material 32 on a substrate 34, such as the ground or a floor, can be transported into the container volume 20 via the ramp section 26 resting on the substrate 34. In this manner, the transitional interface 30 that is formed between the linear portion 28 and the substrate 34 can define a material collection system 36 for conveniently transporting material 32 from the substrate 34 and into the container volume 20 of the stackable container 10. In this manner, material 32 on a substrate 34 can be efficiently moved from the substrate 34 and directly in to the stackable container 10 using a broom, squeegee or other material handling implement.

Referring again to FIGS. 1-10, the contoured upper edge 24 of the rim section 16 includes a planar upper surface 50 that extends continuously through the outwardly extending spout 22 and the ramp section 26, as well as a circular portion 52 of the upper edge 24. In this manner, the upper edge 24 includes a planar upper surface 50 that can conveniently receive a lid 54 that engages the upper edge 24 of the rim section 16. Using this planar configuration of the upper edge 24, the lid 54 and the rim section 16 can form a consistent seal that fully closes the container volume 20 of the stackable container 10. In this manner, the lid 54 includes a spout portion 56 that selectively engages and covers the outwardly extending spout 22, and also includes a ramp portion 58 that selectively engages and covers the ramp section 26 of the upper edge 24. Again, the even configuration of planar upper surface 50 of the upper edge 24 extends through the circular portion 52, the outwardly extending spout 22, and the ramp section 26 of the upper edge 24. This planar configuration cooperates with the lid 54 and fully encloses the container volume 20 and defines a consistent seal between the lid 54 and the stackable container 10.

According to various aspects of the device, the lid 54 and the stackable container 10 can include a seal interface that provides for an airtight enclosure. This can be achieved through an interlocking engagement between the lid 54 and the upper edge 24. Various tabs and clips can also be used to achieve this airtight enclosure. This airtight enclosure is advantageous when certain materials 32 are stored in the container volume 20, such as paint, and other materials 32 that may deteriorate in the absence of an airtight seal.

Referring again to FIGS. 1-10, it is contemplated that the rim section 16 is integrally formed with the body portion 14 such that the circular base 12, the body portion 14, and the rim section 16 are formed as a unitary member that is manufactured from a single piece of material. Typically, the stackable container 10 is formed from plastic or other polymer-type material. It is also contemplated that the stackable container 10 can be formed from metal, composite materials, plastic-type materials, combinations thereof, and other similar materials.

According to various aspects of the device, as exemplified in FIGS. 1-10, the inclusion of the spout 22 and the ramp section 26 do not interfere with the stackable configuration of the stackable container 10 and other conventional buckets. In this manner, the stackable container 10 that includes the spout 22 and the rim section 16 can be stored with other containers 10 that do not include the spout 22 or the ramp section 26 of the rim section 16. Accordingly, the modularity of the stackable container 10 is maintained with respect to conventional buckets, while adding the functionality of the outwardly extending spout 22 and the ramp section 26.

In certain aspects of the device, it is contemplated that the rim section 16 that includes the outwardly extending spout 22 and the ramp section 26 can be a separately formed piece that can be attached to the body portion 14 of the stackable container 10. In such an aspect of the device, the rim section 16 forms an extension of the body portion 14 such that the rim section 16 extends upward from the body portion 14 to form the contoured upper edge 24. In this aspect, it is contemplated that the rim section 16 attaches in such a way that the body portion 14 remains stackable with respect to other containers 10 that may or may not include the rim section 16. Where the rim section 16 is a separate component, the rim section 16 is defined by a ring 60 having a consistent height that attaches to the body portion 14 to form a fluid-type seal, and in some instances, an airtight seal.

Referring again to FIGS. 1-10, the linear portion 28 of the upper edge 24 can include an elastomeric edge 70 that selectively engages the substrate 34 when the stackable container 10 is placed on its side. In this configuration, the elastomeric edge 70 operates with the substrate 34 to conform to the surface profile of the substrate 34 to further define the transitional interface 30. In this manner, the elastomeric edge 70 enhances the transitional interface 30 such that smaller particulate matter, fluids and other similar material 32 can be conveniently translated from the substrate 34 and into the container volume 20 via the transitional interface 30. Where the stackable container 10 includes the elastomeric edge 70, it is contemplated that the elastomeric edge 70 is a resilient or elastic member that can be compressed such that the interaction and sealable interface between the lid 54 and the upper edge 24 of the stackable container 10 is not interfered with due to the presence of the elastomeric edge 70. Accordingly, the elastomeric edge 70 can be defined by a flap of elastomeric material or an elastomeric member having an angled edge.

Figure 10:
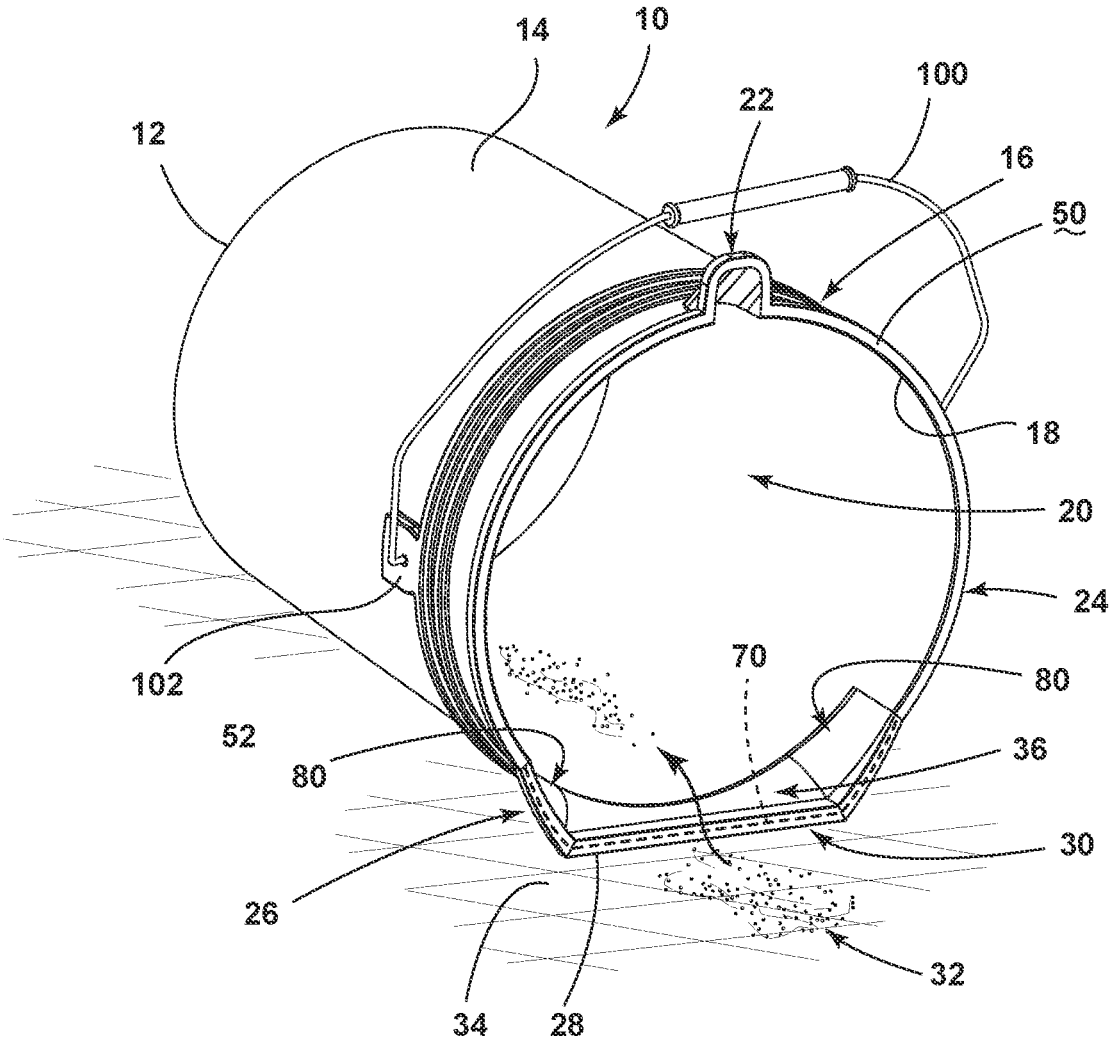
FIG. 10 is a side perspective view of an aspect of the stackable container shown resting on a substrate with the linear portion of the ramp section engaging the substrate to define the transitional interface of the stackable container.

Referring again to FIGS. 1-10, the ramp section 26 can be defined by various configurations of the upper edge 24. In certain aspects of the device, the ramp section 26 can be defined by a generally rectangular extension of the upper edge 24 that extends outward from the circular portion 52 of the upper edge 24. It is also contemplated that the ramp section 26 can be defined by at least one triangular protrusion 80 of the upper edge 24 that cooperates with a circular portion 52 of the upper edge 24 to define the linear portion 28 of the ramp section 26. In this manner, a generally triangular protrusion 80 can form the linear portion 28 that extends outward, typically in a tangential manner, from the circular portion 52 of the upper edge 24. Additionally, where two triangular sections extend outward from the circular portion 52, these two triangular sections can, in essence, form a rectangular protrusion that extends outward from the circular portion 52 in, typically, a generally tangential configuration. The tangential configuration of the ramp section 26 and the circular portion 52 of the upper edge 24 provide for the stability of the stackable container 10 when placed on a substrate 34 and on its side, as shown in FIG. 10. In this manner, the body portion 14 is able to primarily support the weight of the stackable container 10 and the material 32 in the container volume 20. Additionally, the circular portion 52 of the upper edge 24, which is generally reinforced by various ribs defined within the body portion 14 and the rim section 16, is also positioned on the substrate 34 to receive the weight of the stackable container 10 and the material 32 contained therein. The ramp section 26 defines the transitional interface 30 and also provides a stabilizing function that prevents the stackable container 10 from rolling unintentionally. The exact configuration of the ramp section 26 can vary depending upon the design of the stackable container 10 and the various functions to be utilized by the stackable container 10.

The outwardly extending spout 22, similarly, can include various configurations. The profile of the spout 22 can include a triangular configuration, a rounded configuration, a rectilinear configuration, combinations thereof, and other similar configurations that can allow for the formation of the pour spout 22 such that the material 32 within the container volume 20 can be poured out from the stackable container 10. Additionally, it is contemplated that the ramp section 26 can also serve as a pour spout 22 such that the upper edge 24 includes the ramp section 26 but may not include a separate outwardly extending spout 22. Where the outwardly extending spout 22 is included, the spout 22 is typically positioned in diametric opposition to the ramp section 26.

Referring again to FIGS. 1-9, it is contemplated that the lid 54 can include hinges 90, such as living hinges or mechanical hinges within the spout portion 56 and the ramp section 26 of the lid 54. Using the lid 54, where a material 32 is to be poured from the container volume 20 of the stackable container 10, one or both of the spout portion 56 and the ramp portion 58 can be operated from a closed position 92 to an open position 94 (shown in FIG. 4) to allow for pouring of the material 32 contained within the container volume 20. Where both the spout portion 56 and the ramp portion 58 are opened, one side can be used for pouring the material 32 out from the container volume 20, and the other of the ramp portion 58 and spout portion 56 can be utilized to vent air into the container volume 20 to provide for a smooth and generally laminar pour of material 32 from within the container volume 20.

Referring again to FIGS. 1-10, it is contemplated that the stackable container 10 can include a handle 100 that is attached to the body portion 14. The body portion 14 can include integral handle supports 102 that receive ends of the handle 100. This handle 100 includes a metallic member that extends between opposing handle supports 102 that are integral formed with the body portion 14 of the stackable container 10. A grasping feature can be attached to the handle 100 for ease of handling the stackable container 10.

Referring again to FIGS. 1-10, the stackable container 10 can include the circular base 12 and the body portion 14 that extends upward from the circular base 12. The stackable container 10 also includes a rim section 16 that defines an upper edge 24. The body portion 14 extends between the circular base 12 and the upper edge 24 to define the container volume 20. The rim section 16 includes a circular portion 52 and a ramp section 26 that extends outward from the circular portion 52 to define a linear portion 28 of the upper edge 24. This linear portion 28 of the ramp section 26 defines the transitional interface 30 where material 32 on a substrate 34 can be transported into the container volume 20 via the ramp section 26, when the stackable container 10 rests on the substrate 34 with the ramp section 26 resting on the substrate 34.

According to the various aspects of the device, it is contemplated that the stackable container 10 can include the contoured upper edge 24 having a multifunction interface that can be used for a wide range of purposes. The outwardly extending spout 22 and the ramp section 26 of the upper edge 24 can define an anti-rolling feature that prevents the stackable container 10 from rolling away from a user in the case of one or more stackable containers 10 falling over.

It is contemplated that the ramp section 26 can be utilized as a dustpan for collecting small particulate matter, fluids, and other flowable materials. Using the ramp section 26, the stackable container 10 can be utilized for simultaneously gathering material 32 on a substrate 34 without the need for a separate dustpan or other transporting item for moving the flowable material 32 from the substrate 34 to the container volume 20. Additionally, incorporation of the outwardly extending spout 22 and the ramp section 26 within the planar configuration of the upper edge 24 provides for a stackable configuration of the stackable container 10, as well as the use of a lid 54 that can be attached to the upper edge 24 for sealing the container volume 20.

According to various aspects of the device, the stackable container 10 can include additional features. Such features can include, but are not limited to, measurement lines positioned on the inside and the outside of the body portion 14 for measuring the volume of contents within the container volume 20. The stackable container 10 can cooperate with a disposable liner that can be inserted within the container volume 20 and removed for easy disposal of waste and cleanup of the stackable container 10. The body portion 14 can also include a vertical volume indicator that includes a translucent or transparent window for ascertaining the amount of material 32 contained within the container volume 20 without removing the lid 54 from the upper edge 24. The lid 54 can also include a removable cap that can be used in combination with various paint sprayers, siphons, and other similar suction-operated devices. As described herein, the planar configuration of the upper edge 24 that incorporates the spout 22 and the ramp section 26 is configured to maintain the airtight configuration of the interface between the lid 54 and the rim section 16 for maintaining this seal to allow for suction-operated devices to operate with the stackable container 10.

Unique features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

It will be understood by one having ordinary skill in the art that construction of the described disclosure and other components is not limited to any specific material. Other exemplary embodiments of the disclosure disclosed herein may be formed from a wide variety of materials, unless described otherwise herein.

What is claimed is:

1. A stackable container comprising:

a circular base;

a body portion that extends upward from the circular base and having handle supports; and a rim section having an opening, wherein the body portion extends between the circular base and the rim section to define a container volume, the handle supports positioned on the body portion, the rim section comprising:

an outwardly extending spout defined within an upper edge; and a ramp section defining a linear portion of the upper edge, wherein the linear portion of the ramp section defines a transitional interface where material on a substrate can be transported into the container volume via the ramp section resting on the substrate, wherein the outwardly extending spout and the ramp section are positioned within the rim section and above the handle supports.

2. The stackable container of claim 1, further comprising a lid that engages the upper edge of the rim section.

3. The stackable container of claim 2, wherein the lid includes a spout portion that selectively engages and covers the outwardly extending spout and the ramp section.

4. The stackable container of claim 1, wherein the upper edge of the rim section includes a planar upper surface that extends continuously through the outwardly extending spout and the ramp section.

5. The stackable container of claim 1, wherein the rim section is integrally formed with the body portion.

6. The stackable container of claim 1, wherein the rim section is a separate component that is coupled to the body portion.

7. The stackable container of claim 1, wherein the linear portion of the upper edge includes an elastomeric edge that selectively engages the substrate to form a surface profile of the substrate to further define the transitional interface.

8. The stackable container of claim 1, further comprising a handle that is attached to the body portion, the body portion including integral handle supports that receive ends of the handle.

9. The stackable container of claim 3, wherein the ramp section is positioned in diametrical opposition to the outwardly extending spout.

10. The stackable container of claim 1, wherein the ramp section is defined by at least one triangular protrusion of the upper edge that cooperates with a circular portion of the upper edge to define the linear portion of the ramp section, and wherein a portion of the triangular protrusion extends from the circular portion of the upper edge in a tangential configuration.

11. A stackable container comprising:

a circular base;

a body portion having a tapered cylindrical form that extends upward from the circular base;

a rim section having an upper edge; and a handle support positioned below the upper edge, wherein the body portion extends between the circular base and the upper edge to define a container volume, wherein the rim section includes a circular portion and a ramp section that extends outward from the circular portion to define a linear portion of the upper edge, wherein the linear portion of the ramp section defines a transitional interface that extends from the upper edge to an area above the handle support, where material on a substrate can be transported into the container volume via the ramp section resting on the substrate, wherein the linear portion of the upper edge is tangential to a circle defined by the circular portion of the upper edge.

12. The stackable container of claim 11, wherein the upper edge includes an outwardly extending spout that is positioned in opposition to the linear portion of the upper edge.

13. The stackable container of claim 11, further comprising a lid that engages the upper edge of the rim section.

14. The stackable container of claim 13, wherein the lid includes a spout portion that selectively engages and covers the outwardly extending spout and the ramp section.

15. The stackable container of claim 11, wherein the upper edge of the rim section includes a planar upper surface that extends continuously through the outwardly extending spout and the ramp section.

16. The stackable container of claim 11, wherein the rim section is integrally formed with the body portion.

17. The stackable container of claim 11, wherein the linear portion of the upper edge includes an elastomeric edge that selectively engages the substrate to form to a surface profile of the substrate to further define the transitional interface.

18. The stackable container of claim 11, wherein the ramp section is defined by at least one triangular protrusion of the upper edge that cooperates with a circular portion of the upper edge to define the linear portion of the ramp section.

19. A stackable container comprising:

a circular base;

a body portion that extends upward from the circular base;

a rim section having an opening, wherein the body portion extends between the circular base and the rim section to define a container volume, the rim section including an outwardly extending spout defined within an upper edge, and a ramp section defining a linear portion of the upper edge;

handle supports that are positioned on the body portion, wherein the outwardly extending spout and the ramp section extend between the opening and a bottom of the rim section proximate the handle supports; and a lid that engages the upper edge of the rim section, wherein, the lid includes a spout portion that selectively engages and covers the outwardly extending spout and the ramp section;

the upper edge of the rim section includes a planar upper surface that extends continuously through the outwardly extending spout and the ramp section; and the linear portion of the ramp section defines a transitional interface where material on a substrate can be transported into the container volume via the ramp section resting on the substrate.

20. The stackable container of claim 19, wherein the ramp section is defined by at least one triangular protrusion of the upper edge that cooperates with a circular portion of the upper edge to define the linear portion of the ramp section, wherein a portion of the triangular protrusion is tangential to the circular portion of the upper edge.

* * * * *